United States Patent [19]

Würmli

[11] Patent Number: 4,524,579

[45] Date of Patent: Jun. 25, 1985

[54] DEVICE FOR DONNING BOBBINS ONTO A TRANSPORT BAND

[75] Inventor: Arthur Würmli, Winterthur, Switzerland

[73] Assignee: Rieter Machine Works Ltd., Winterthur, Switzerland

[21] Appl. No.: 605,805

[22] Filed: May 1, 1984

[30] Foreign Application Priority Data

May 6, 1983 [CH] Switzerland ..... 2476/83

[51] Int. Cl.[3] ..... D01H 9/18

[52] U.S. Cl. ..... 57/276; 57/81; 57/274; 198/395; 198/401

[58] Field of Search ..... 57/78, 89, 81, 83, 264–278; 198/395, 401, 502

[56] References Cited

U.S. PATENT DOCUMENTS 4,307,807 12/1981 Oswald et al. ..... 57/274 X
4,338,778 7/1982 Suzuki et al. ..... 57/276

FOREIGN PATENT DOCUMENTS 1280108 7/1963 Fed. Rep. of Germany .
2910091 9/1980 Fed. Rep. of Germany .
3026075 1/1981 Fed. Rep. of Germany .
1237622 11/1959 France .
2345542 3/1977 France .

*Primary Examiner*—John Petrakes
*Attorney, Agent, or Firm*—Werner W. Kleeman

[57] ABSTRACT

A device for mounting or donning of bobbins onto a transport band of a textile machine, especially a ring spinning or ring twisting machine contemplates that incorrectly mounted bobbins are ejected or doffed by a bar member pivotable about a pivot axis or shaft. To eject or doff such incorrectly mounted bobbins the bar member is moved, at a monitoring or control position, in a downward direction towards the head of the bobbin currently there located and ejects incompletely mounted bobbins. The donning device exhibits simplicity and a reliable mode of operation. Furthermore, by means of the invention damage produced by incorrectly mounted bobbins is avoided and damaged bobbins are removed from the operating process.

7 Claims, 2 Drawing Figures

DEVICE FOR DONNING BOBBINS ONTO A TRANSPORT BAND

BACKGROUND OF THE INVENTION

The present invention relates to a new and improved device for mounting or donning bobbins onto a transport band or the like of a textile machine, especially a ring spinning or ring twisting machine, wherein the transport band is provided with positioning pins for positioning the bobbins, and the feed of the bobbins to the transport band takes place at a fixed loading or donning position or location.

When donning bobbins onto the spindles of a ring spinning machine or a ring twisting machine, a plurality of bobbins located on a transport band or belt are simultaneously grasped and these bobbins are thereafter donned, also simultaneously, onto the spindles. It is important that the bobbins on the transport band are exactly positioned. A bobbin which has not been completely mounted or donned onto its positioning or mounting pin can be destroyed during grasping by the gripper beam or the like. Also, in some circumstances the gripper beam can be bent or the transport band can be damaged. Faulty donning of bobbins generally is caused by damaged bobbins, in particular by damage at the foot or base of the bobbin. It is therefore important that damaged bobbins are eliminated from the operating process or procedure of the machine.

From U.S. Pat. No. 3,410,452 it is known to the art to remove bobbins individually from a container and to mount or don them individually onto a transport band at a transfer position or location. In this patent, there are not disclosed or shown any means to monitor the accuracy of the positioning of the bobbins upon the transport band.

German Published Pat. No. 1,121,514 relates to a machine for sorting bobbins. The bobbins are provided with recognition rings. In accordance with the teachings of this patent, the sorting operation is effected with the aid of photocells and a detector device. The ejection or doffing of the bobbin packages is effected by means of ejectors, such as horizontally movable strikers or impact elements. The selection of damaged bobbins is not contemplated.

SUMMARY OF THE INVENTION

Therefore, with the foregoing in mind, it is a primary object of the present invention to provide a new and improved construction of a donning device for bobbins or the like which is not afflicted with the aforementioned drawbacks and limitations of the prior art.

Another important object of the present invention aims at the provision of an improved construction of a bobbin donning device, wherein the removal of damaged bobbins from the operating process is reliably achieved while avoiding the above-mentioned disadvantages.

Yet a further significant object of the present invention is directed to the provision of a new and improved construction of a device for donning bobbins onto a transport band or the like and containing means for the effective and reliable removal of damaged bobbins, wherein such arrangement is relatively simple in construction and design, extremely economical to manufacture, highly reliable and efficient in operation, not readily subject to breakdown or malfunction, and requires a minimum of maintenance and servicing.

Now in order to implement these and still further objects of the invention, which will become more readily apparent as the description proceeds, the device of the present invention comprises a bar member which is pivotally movable out of a substantially horizontal starting position, and means cooperate with the bar member in order to subject such bar member to a resilient biasing or spring force for urging the bar member back towards this starting position. For the ejection or doffing of bobbins which have been incompletely donned or mounted upon a positioning pin, the bar member is movable upwardly and downwardly at a monitoring location or position arranged after the loading or donning position considered with respect to the direction of movement of the transport band. During the downward movement of the bar member the latter is movable with an end portion thereof towards the bobbin head of the bobbin currently located at the monitoring position, in order to bring about ejection or doffing of a bobbin incompletely mounted upon the positioning pin by the downwardly moving bar member with pivoting thereof through an acute angle with respect to the bobbin.

The device according to the invention therefore has the advantage of great simplicity and thus greater reliability. It produces automatic sorting of damaged bobbins from the remaining bobbins, which brings about a savings in operation in a spinning mill.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analogous components and wherein.

DETAILED DESCRIPTION OF THE PREFERRED EMBODIMENTS

Figure 1:
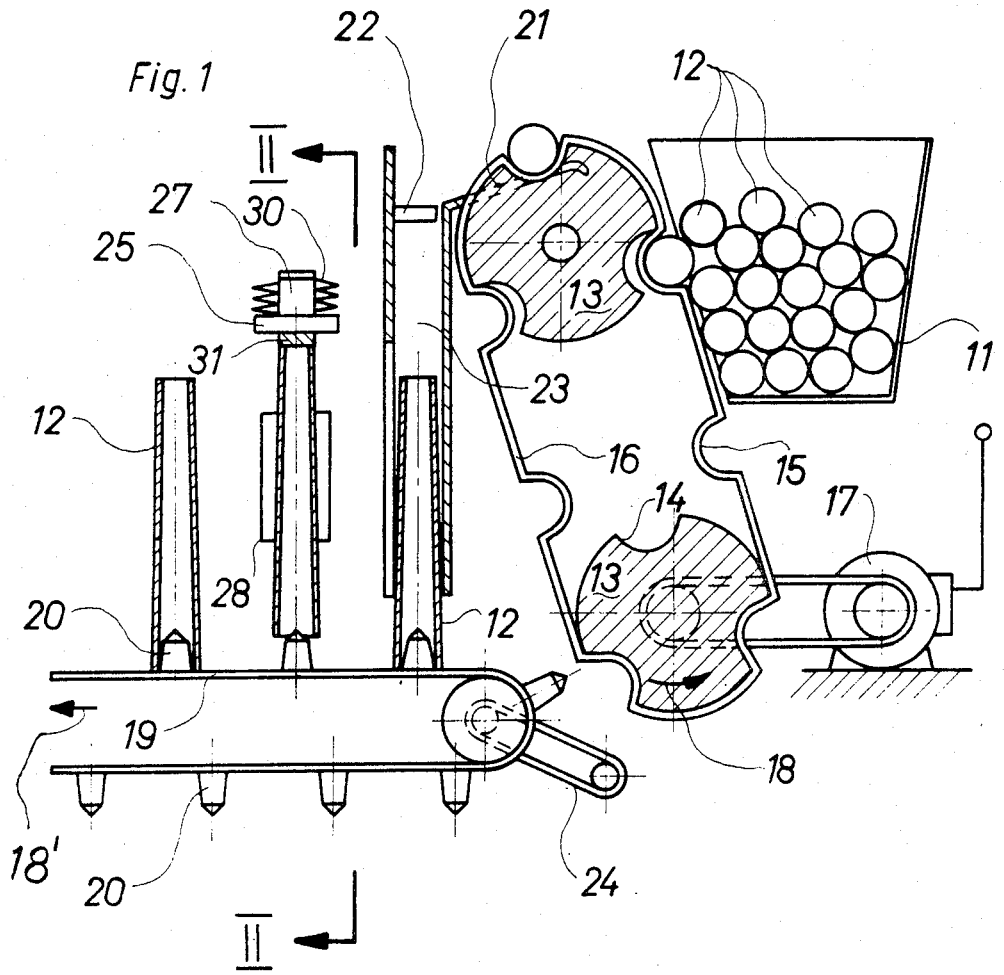
FIG. 1 shows a section of a device for mounting or donning bobbins onto a transport band or the like and equipped with an arrangement for doffing improperly mounted bobbins.

Describing now the drawings, it is to be understood that for purposes of simplifying the showing thereof, only enough of the construction of the bobbin donning device and its related bobbin doffing or ejection structure has been illustrated as needed for those skilled in the art to readily understand the underlying principles and concepts thereof. Turning attention now to FIG. 1 of the drawings, it will be seen that a supply of bobbins 12 is located in a suitable container 11. A feed or conveying device is provided which here comprises two rolls or rollers 13, each of which is provided with recesses or pocket-like depressions 14. A conveying or conveyor band 16 formed with recessed pockets 15 runs over these rolls 13. The drive of the conveying band 16 is provided by means of any suitable drive motor 17 which, as shown in FIG. 1, serves to rotate the lower roll 13 in the direction of the arrow 18.

Positioning pins or plugs 20 or equivalent bobbin mounting facilities are arranged and mounted at a predetermined spacing from one another on a transport band or belt 19 for the bobbins 12. The bobbins 12 are donned onto these positioning pins 20. The mutual spacing of two neighboring positioning pins 20 is essentially equal to the spindle gauge, i.e. is equal to the spacing of neighboring spindles on the related ring spinning or ring twisting machine. The bobbins 12 to be donned are individually lifted from the bobbin conveying band 16 by means of a table 21 or equivalent structure. A deflection pin 22 serves to divert the falling bobbins 12 into a drop or fall chute 23. The transport band 19 is driven by any suitable drive 24.

The bobbin drop chute 23 is located at the bobbin loading or donning position where there occurs loading or donning of the bobbins 12 onto the transport band 19. In accordance with the invention, an additional monitoring or control position is provided and at which location there are ejected or doffed bobbins 12 which have been incompletely mounted upon the transport band 19 i.e. upon a related positioning pin 20. In the arrangement of FIG. 1, the monitoring or control location or position is located at the position of the intermediate bobbin 12 of the three bobbins which are located over the transport band 19. The arrow 18' indicates the direction of movement of the transport band 19 and the bobbins 12 carried thereby.

Figure 2:
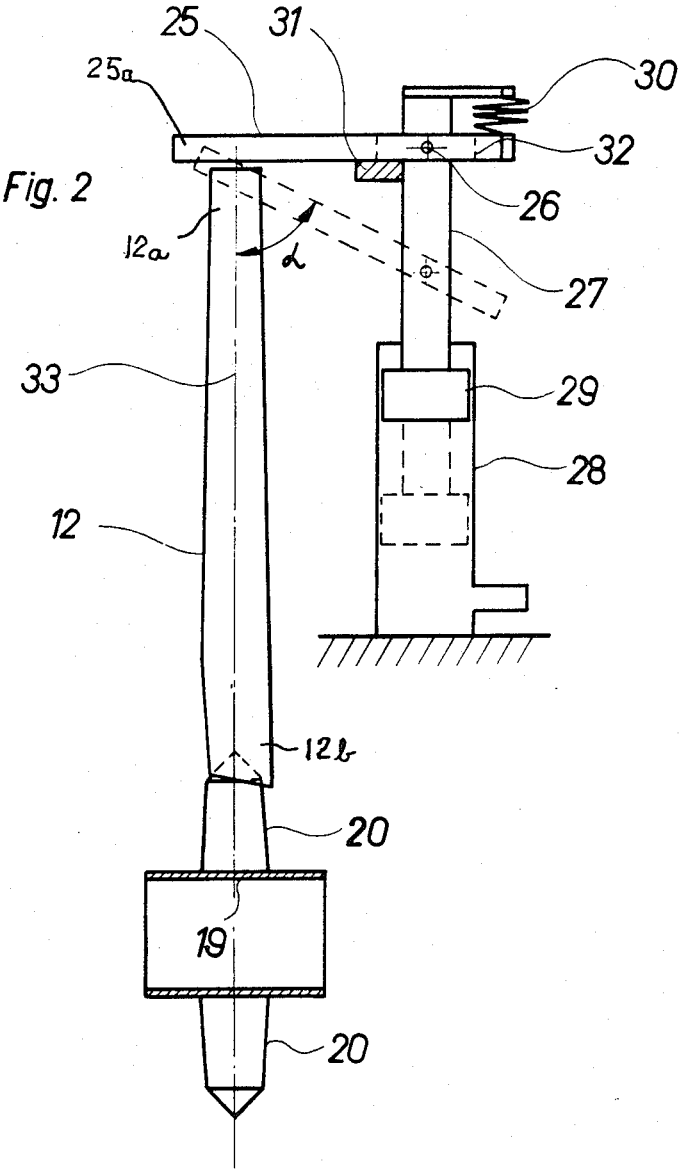
FIG. 2 shows a side sectional view of the device depicted in FIG. 1, taken substantially along the lines II—II thereof and depicting details of the bobbin doffing or ejecting arrangement according to the invention.

FIG. 2, which is a sectional view of the arrangement of FIG. 1, is drawn to a larger scale than FIG. 1. It shows once again a bobbin 12, the transport band 19 and one of the positioning or mounting pins 20. It is assumed that the bobbin 12 has been squashed, i.e., damaged at its foot or base portion and is not correctly mounted on its positioning pin 20 as such improper mounting has also been illustrated in FIG. 1. To remove any such damaged bobbin 12, the invention advantageously contemplates providing a bar or bar member 25 or equivalent structure which is pivotable about a pivot axis or shaft 26. This pivot shaft or axis 26 is carried by a piston rod or rod member 27 and extends, for instance, substantially perpendicular to the lengthwise direction of extent of the bar member 25. Since the rod member 27 is movable upwardly and downwardly, this is also the case for the bar or bar member 25. In the illustrated exemplary embodiment the piston rod 27 is elevationally displaceable by means of a piston 29 movable in a cylinder 28. The bar or bar member 25, serving to remove the damaged bobbins 12, is resiliently biased or loaded by means of a tension spring 30 or equivalent structure. In its rest or starting position, this bar member 25 is disposed in a substantially horizontal position and engages with an abutment or stop member 31. The abutment or stop 31 is fixed to the displaceable piston rod 27 which reciprocates within the cylinder 28. In order to enable free pivoting of the bar or bar member 25 about the pivot axis or shaft 26, the bar member 25 is provided with an opening 32 illustrated in dotted lines in FIG. 2.

For mounting or donning of the bobbins 12 onto the transport band 19, the latter is set in motion by the drive 24 and the conveying or conveyor band 16 is placed into operation by the drive motor 17. The bobbins 12 passing onto the table 21 roll towards the diverting or deflecting pin 22 and are caused by the latter to fall through the bobbin drop chute 23 with the bobbin foot directed downwardly. The endless conveying band 16 and the endless transport band 19 are synchronized in such a manner that each falling bobbin 12 drops onto a positioning or mounting pin 20.

In the illustrated exemplary embodiment, an operating method is disclosed in which the transport band 19 is moved in a stepwise fashion. Whenever the transport band 19 is stationary between individual steps of its incremental movement, a positioning pin 20 is located at the bobbin loading or donning position, i.e., beneath the bobbin drop or fall chute 23. It will be apparent from FIG. 1 that, since the spacing of adjacent positioning pins 20 is essentially equal to the spindle gauge of the related textile machine, the monitoring or control position is spaced from the bobbin loading or donning position by a distance which is equal to the spindle gauge. It can, however, also be equal to double or triple the spindle gauge, i.e, an integer multiple thereof.

During such time as the transport band 19 is stationary, the piston or piston member 29 is moved downwardly, thereby moving the piston rod 27 and also the bar or bar member 25. This movement takes place through at least such a distance that the end portion **25*a* of the bar member 25 located at the left of the showing of FIG. 2 at least still engages the bobbin head 12*a* of a bobbin 12 correctly mounted on the transport band 19. A correctly mounted bobbin 12 is one which is completely mounted on its associated positioning or mounting pin 20**.

In FIG. 2 there is depicted a bobbin 12 having a squashed foot or base portion **12*b* and which is not located in a position corresponding to a correctly mounted bobbin. In this case, the bar or bar member 25 already presses at the start of its downward movement against the head or upper portion 12*a* of the bobbin 12. Since this bobbin 12 pushes against the positioning pin 20, the bar member 25 is rotated, in the illustrated arrangement, in a clockwise direction about its pivot shaft or axis 26 and thereby forms with the bobbin 12 and its lengthwise extending or longitudinal axis 33 an acute angle $\alpha$, as indicated in dotted lines in FIG. 2. As a result the bobbin head 12*a* is pushed away towards the left in FIG. 2, and thus, the bobbin 12** is ejected or doffed.

It can happen that the damage to the bobbin 12 is relatively inconsequential, so that such bobbin is not ejected or doffed during the described operation, but instead is pressed by the bar member 25 into a position where it is correctly seated upon the positioning or mounting pin 20. In this case, correct removal of this bobbin during donning of the latter on the spindle is assured. Such subsequent pressing of the bobbins 12 into their correctly seated position is desired, since thereby the exactness of the positioning of the bobbins 12 is improved. This mode of operation therefore constitutes a further advantage of the present invention.

The acute angle $\alpha$ formed between the bar or bar member 25 and the longitudinal axis 33 of a correctly mounted bobbin 12 depends upon the mutual spacing of the pivot shaft or axis 26 from the longitudinal axis 33 of the bobbin 12 currently located at the monitoring or control position; the closer these are to one another the larger is the angle $\alpha$ for a given length of downward movement of the bar member 25. The angle $\alpha$ can, in practice, be greater than 45°. A minimum value assuring for positive ejection or doffing of the bobbins, with adequate dimensioning of the parts effecting the bobbin ejection or doffing operation, is approximately 25°.

While there are shown and described present preferred embodiments of the invention, it is to be distinctly understood that the invention is not limited thereto, but may be otherwise variously embodied and practiced within the scope of the following claims. Accordingly,

What I claim is:

1. A device for donning of bobbins onto a transport band of a textile machine, especially a ring spinning or ring twisting machine and for doffing improperly donned bobbins, wherein the transport band is provided with positioning pins serving for positioning of the bobbins and the feed of bobbins to the transport band takes place at a predetermined bobbin loading position, comprising:

a bar member for the removal of damaged bobbins;

means for pivotably mounting said bar member for movement out of a substantially horizontal starting position;

means for subjecting said bar member to a resilient biasing action urging said bar member back towards said substantially horizontal starting position;

means for moving said bar member upwardly and downwardly at a bobbin monitoring position arranged after the bobbin loading position with respect to a predetermined direction of movement of the transport band, in order to doff bobbins incompletely mounted over a positioning pin of the transport band; and said moving means acting upon said bar member such that said bar member is movable at an end portion thereof, during its downward movement, towards a bobbin head of the bobbin currently located at the bobbin monitoring position, in order to effectuate doffing of a bobbin incompletely mounted over a positioning pin by the downwardly moving bar member with pivoting of the bar member into a position forming an acute angle $\alpha$ with respect to the lengthwise axis of said incompletely mounted bobbin.

2. The device as defined in claim 1, wherein:

said means for pivotably mounting said bar member comprises a substantially horizontally arranged pivot shaft disposed substantially perpendicular to a lengthwise direction of extent of said bar member.

3. The device as defined in claim 1, wherein:

said means for pivotably mounting the bar member comprises a pivot shaft coaxially arranged at a predetermined pivot axis of the bar member;

said moving means for the bar member comprises an upwardly and downwardly movable rod member for supporting said pivot shaft; and said moving means further comprises drive means for upwardly and downwardly moving said rod member.

4. The device as defined in claim 3, wherein:

said means for subjecting said bar member to a resilient biasing action comprises a spring; and an abutment with which engages said bar member in said substantially horizontal starting position.

5. The device as defined in claim 3, wherein:

at the location of the bobbin monitoring position the spacing of the pivot axis of the bar member from the longitudinal axis of a bobbin which is correctly mounted is chosen in such a manner that the pivoting of the bar member assumes an angle of at least approximately 25° with respect to the longitudinal axis of the bobbin during doffing of the bobbins.

6. The device as defined in claim 1, wherein:

the positioning pins are arranged at a spacing from one another substantially equal to a predetermined spindle gauge of the textile machine and the transport band performs stepwise transport movements; and the spacing of the bobbin monitoring position from the bobbin loading position being an integer multiple of said predetermined spindle gauge.

7. The device as defined in claim 1, wherein:

the downward movements of the bar member take place through at least a distance such that there occurs contact of the bar member with a bobbin head of a correctly mounted bobbin.

* * * * *